United States Patent [19]

Ikawa et al.

[11] Patent Number: 4,672,273

[45] Date of Patent: Jun. 9, 1987

[54] ELECTRONIC FLASH DEVICE FOR CAMERA

[75] Inventors: Kazuo Ikawa; Isao Watanabe, both of Kanagawa, Japan

[73] Assignee: Canon Kabushiki Kaisha, Tokyo, Japan

[21] Appl. No.: 635,287

[22] Filed: Jul. 27, 1984

[30] Foreign Application Priority Data

Jul. 30, 1983 [JP] Japan ..... 58-119668[U]
Jul. 30, 1983 [JP] Japan ..... 58-119669[U]

[51] Int. Cl.[4] ..... H05B 37/00; H05B 39/00; H05B 41/14

[52] U.S. Cl. ..... 315/241 P; 354/145.1; 354/147; 315/74; 315/242

[58] Field of Search ..... 315/241 P, 74, 241 R, 315/244, 242; 354/145.1, 147

[56] References Cited

U.S. PATENT DOCUMENTS 4,162,836 7/1979 Harrison ..... 354/145.1
4,196,458 4/1980 Kondo ..... 315/241 P X
4,204,140 5/1980 Willis ..... 315/241 P
4,510,419 4/1985 Takematsu ..... 315/241 P

*Primary Examiner*—Saxfield Chatmon
*Attorney, Agent, or Firm*—Toren, McGeady & Associates

[57] ABSTRACT

The enclosed electronic flash device for a camera includes a booster circuit connectible to an electrical power source or battery, a high voltage rectifier diode for rectifying the output of the booster circuit, and a storage capacitor. A main power supply switch and an auxiliary power supply switch are connected in series between the negative poles of the power source and capacitor. The auxiliary power supply switch is arranged to close when the flash device is attached to the camera. A signal terminal is connected to the negative pole of the storage capacitor through other circuit elements and another signal terminal is connected to one contact of the auxiliary power supply switch, which is connected in turn to the negative pole of the storage capacitor. The auxiliary power supply switch is connected in series with the main power supply switch at a point farther from the negative terminal of the battery than the main power supply switch.

9 Claims, 6 Drawing Figures

ELECTRONIC FLASH DEVICE FOR CAMERA

BACKGROUND OF THE INVENTION

1. Field of the Invention

This invention relates to improvements in electronic flash devices for cameras having an auxiliary power supply switch (or "auxiliary switch") arranged to close when the device is attached to the camera.

2. Description of the Prior Art

Electronic flash devices of the kind described generally have an electrical circuit as shown in FIG. 1. The voltage of a battery 1 is converted to an alternating current of increased voltage by a booster I. Booster I includes a battery capacitor 2, an oscillating transistor 3, a bias capacitor 4, an oscillating transformer 5 having a saturated iron core, and a resistor 6. The output of booster I passes through a high voltage rectifier diode 7 to a main or storage capacitor 8. Use of a manually operated main switch 9 is generally sufficient to initiate operation of the booster circuit I. However, if the power supply is controlled only by the main switch 9, a problem arises. When the electronic flash device is not used for a long time and is detached from the camera, while leaving the battery switch 9 ON, the booster circuit I continues to operate, causing wasteful consumption of the electrical energy of the battery. One proposed, and utilized, way of avoiding this has been to provide this kind of electronic flash device with an auxiliary battery switch 10 arranged to open or close when the device is detached from or in use with the camera.

FIG. 2 illustrates the construction of such an auxiliary switch 10. An embossed portion is formed on the inner surface of a casing of the electronic flash device. A print substrate 102 fixed by the fastener screws 101 is mounted on the embossed portion. A switch contact in the form of a plunger rod 10*s* passes through a fitted hole provided through the wall of the print substrate 102 and is urged by a coil spring 103 to move away from a fixed contact 10*a* when the device is detached from the camera. The coil spring 103, plunger 10*s* and a copper foil pattern 10*c* of the print substrate 102 are always electrically connected with one another, constituting a movable contact of the switch 10. When the device is attached to the camera, end "a" of the plunger 10*s* is brought into electrical connection with a terminal on the camera housing (not shown). At the same time, the opposite end of plunger 10*s* contacts the resilient contact member 10*a*. The auxiliary switch 10 is thus turned on. When the main switch 9 is then turned on with movable contact 9*s* in contact with a contact 9*a*, the booster circuit I starts to oscillate. When the device is then detached from the camera, auxiliary switch 10 is turned off and operation of booster circuit I is automatically stopped, even when the main switch 9 is still in the ON state.

Current induced in the secondary winding S of the oscillation transformer 5 flows in a closed circuit from the high voltage rectifier diode 7 through the storage capacitor 8, closed main switch 9, closed auxiliary switch 10, battery 1, capacitor 2 connected in parallel to the battery 1 and the emitter-to-base path of oscillating transistor 3 to the opposite end of the secondary winding S. With the electronic device on the camera, this closed circuit changes to the open position when the main switch 9 changes from its ON to OFF state, or when chattering takes place at the time of contact between the members 9*s* and 9*a* of the main switch.

Current flowing through the closed circuit is divided into two parts, one of which serves as a charging current for the storage capacitor 8. Another part flows through the emitter-base path of oscillating transistor 3, becoming a positive feedback current to booster circuit I. Because the opening of this closed circuit results in an increased impedance between the lines A and B, a surge voltage is produced for a very short time across lines A and B. The higher the impedance of the circuit beginning with the base of oscillating transistor 3 with resistor 6 and terminating at the main switch contact 9*c*, inevitable for actuating booster circuit I, the more prominent the surge voltage becomes. Such surge voltage does not create any problem provided that the synchronizing switch for controlling the timing of firing of the electronic flash device is in the form of a mechanical switch 11, as shown in FIG. 1. This prevails in the prior art.

For cameras employing a CMOS type integrated circuit of low withstand voltage from which an actuating signal for firing the device is obtained, however, the production of a surge voltage across lines A and B becomes a serious problem, because the surge voltage is applied backwards through the interconnection terminal leading from line B to the CMOS type integrated circuit and from there to line A. It is therefore unavoidable that the integrated circuit and associated parts therewith are broken as the withstand voltage is exceeded.

To prevent such withstand voltage damage, a diode of high withstand voltage may be connected in such a direction to not apply the surge voltage directly to the integrated circuit. With the reduced driving voltage for the integrated circuit, however, the output signal of the diode is lowered by the voltage loss (about 0.6 volts) in the forward direction to a value depending on the ambient temperature and an alternative problem of securing the accuracy and reliability of control results. The use of such a diode cannot be said to be an advantageous solution.

SUMMARY OF THE INVENTION

A first object of the present invention is to eliminate the above-described problem and to provide an electronic flash device for a camera capable of preventing the withstand voltage damage to the circuitry of the camera which would otherwise result from the application of the surge voltage backward to the camera when the main power supply switch is turned off while the device is in use on the camera.

To achieve this, according to the present invention, the auxiliary switch connected in series to the main switch is positioned farther from the negative terminal of the battery than the main switch, and one of the contacts of the auxiliary switch which is connected to a signal line, is connected to the negative pole of the storage capacitor so that a circuit connecting the signal line to another signal line is not cut off when either of the main or auxiliary switches is turned off.

A second object of the invention is to provide or electronic flash device of the construction described above having an arrangement for preventing an indicator lamp from being lit to give a spurious signal representing that a full charging of the storage capacitor has occurred which would otherwise result when the storage capacitor is fully charged, the main switch is turned off and the device is shortly thereafter detached from the camera.

To achieve this object, according to the present invention, in the electronic flash device of the construction described above, a one-way semiconductor element is connected in parallel to the aforesaid auxiliary switch. The one-way semiconductor element is oriented so that its forward direction coincides with the direction in which the full charging indicator lamp is short-circuited. Accordingly, even when the auxiliary switch is in the OFF state, the indicator lamp is maintained short-circuited by the one-way semiconductor element.

Other objects of the invention will become apparent from the following description of embodiment thereof.

DETAILED DESCRIPTION OF THE PREFERRED EMBODIMENT

The present invention will next be described in connection with an illustrated embodiment thereof.

Figure 1:
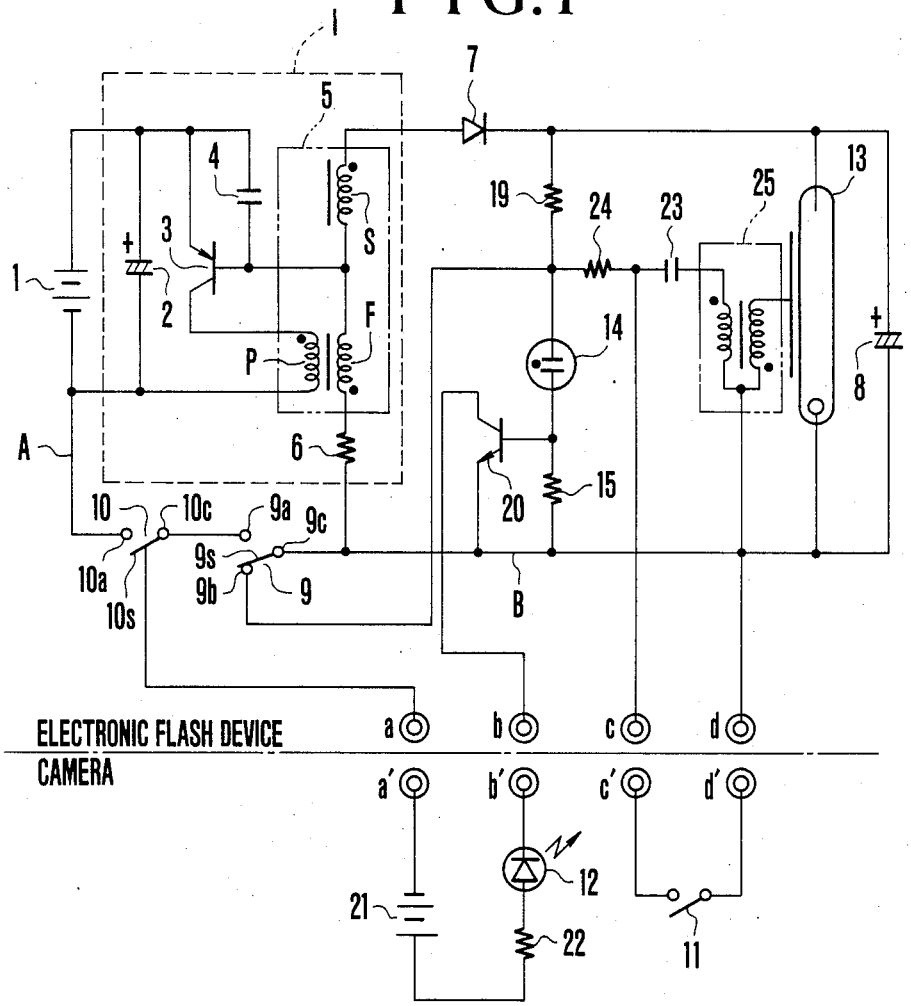
FIG. 1 is an electrical circuit diagram of the conventional electronic flash device.
Figure 2:
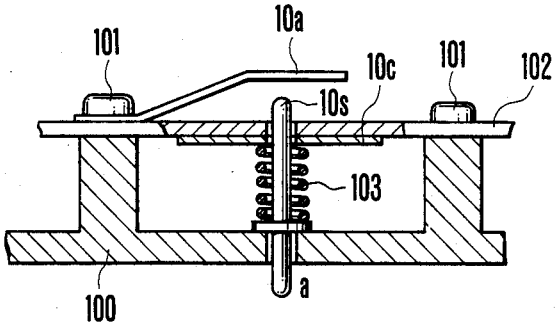
FIG. 2 is a sectional view of an example of the conventional auxiliary power supply switch.
Figure 3:
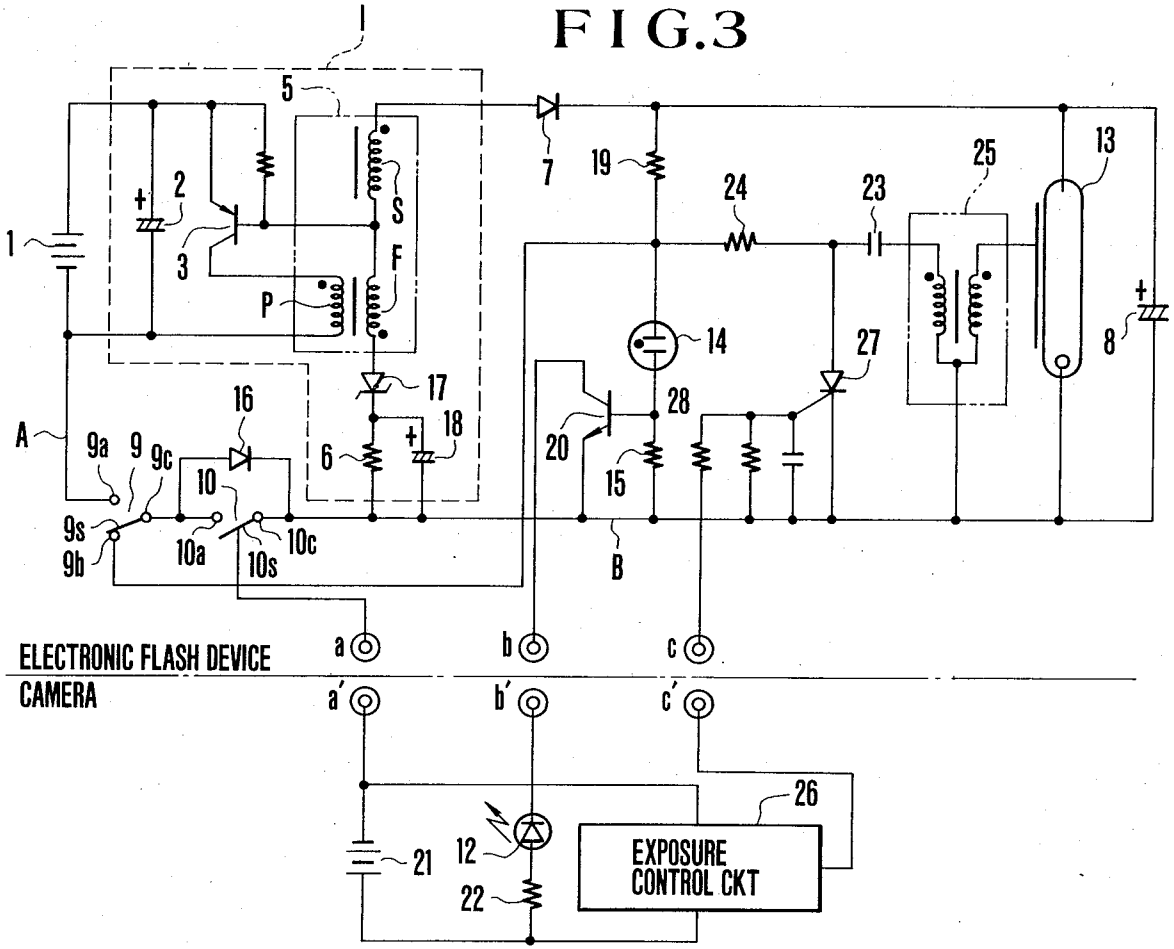
FIG. 3 is an electrical circuit diagram of an embodiment of the present invention.
Figure 4:
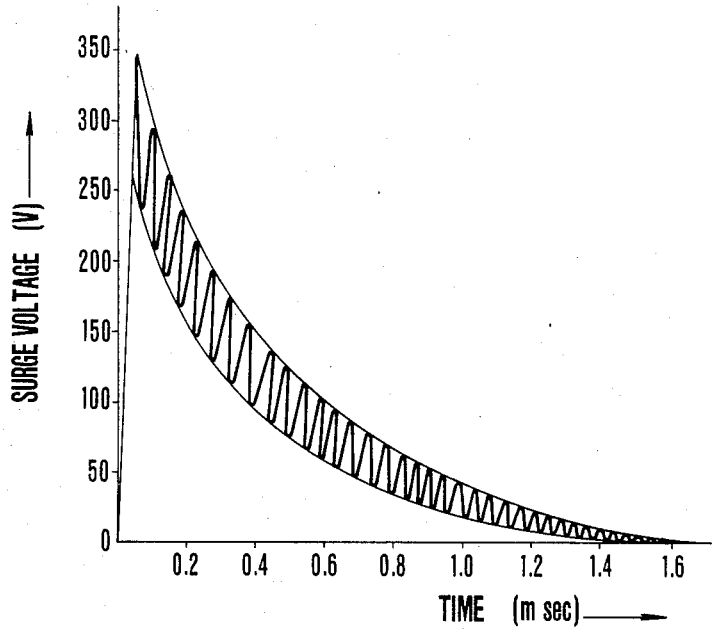
FIGS. 4 to 6 are graphs illustrating surge voltages produced when the main switch is turned off.
Figure 5:
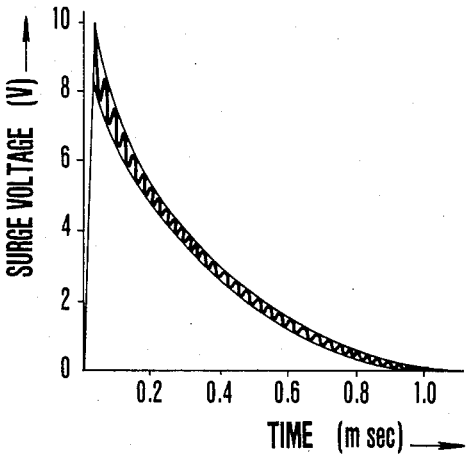
Figure 6:
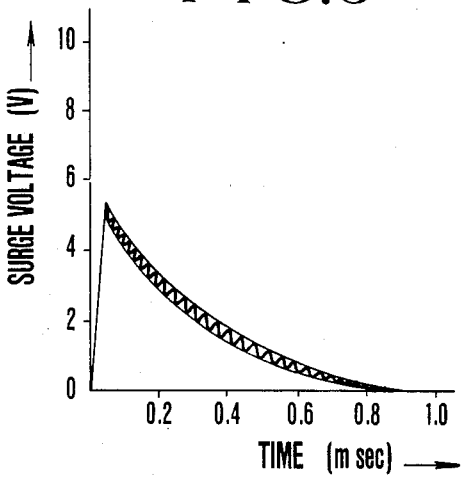

FIG. 3 illustrates an embodiment of the present invention where the same reference characters have been employed to denote similar parts to those shown in FIG. 1. In particular, a feature of the embodiment of FIG. 3 is that to achieve stabilization of the charging characteristics of the DC-DC converter comprising the booster circuit I and high voltage rectifier diode 7, a semiconductor element such as a Zener diode 17 is connected to a circuit for compensating the initial actuation of the booster circuit I. The use of the Zener diode 17, however, tends to intensify the surge voltage between a line A and another line B. FIG. 4 illustrates variation with time of the surge voltage produced in a case where, instead of the Zener diode 17, a diode is used. FIG. 5 illustrates another case where the Zener diode 17 of FIG. 3 has a Zener voltage of 6 volts. FIG. 6 illustrates still another case where the Zener diode 17 of FIG. 3 is short-circuited. As illustrated in FIGS. 4 to 6, so long as either the main battery switch 9 or the auxiliary switch 10 is provided in between the lines A and B, though the peak value varies with the impedance of the compensating circuit for the initial stage of operation of the booster circuit I, it is impossible to reduce it to zero because of the basic characteristics of the DC-DC converter.

To prevent such surge voltage from being transferred to the interior of the camera, in the embodiment of FIG. 3, the auxiliary switch 10 is connected in series to the main switch 9 but positioned farther from the negative terminal of the battery 1 than the main switch 9. Further, the one of the contacts of the auxiliary switch which is connected through a pole 10*s* to an earth or signal terminal "a", namely the contact 10*c*, is connected with the line B.

Another feature is that the main switch 9 includes an additional fixed contact 9*b* arranged so that when the switch 9 is turned off, that is, when the pole 9*s* is moved away from the first fixed contact 9*a*, the pole 9*s* touches the second fixed contact 9*b*, and is connected to the anode of a neon lamp 14. Auxiliary switch 10 is provided with a diode 16. The anode and cathode of diode 16 are connected to the contacts 10*a* and 10*c* of the auxiliary switch 10 respectively. Thus, the forward direction of connection of the diode 16 coincides with the direction in which the neon lamp 14 is short-circuited.

In operation, when the electronic flash device is slipped into the accessory shoe of a camera, the circuit earth terminal, "a", charging completion signal terminal, "b", and flash lamp triggering signal terminal, "c", on the casing of the electronic flash device, are connected with respective signal terminals, a', b' and c' on the housing of the camera. At the same time, the plunger or pole 10*s* of the auxiliary switch 10 moves to contact fixed contact 10*a*, thereby turning the auxiliary switch on. When main switch 9 is then turned on by manually bringing the pole 9*s* into contact with the first fixed contact 9*a*, current from the positive terminal of battery 1 flows through the feedback winding F of oscillation transformer 5, Zener diode 17 for matching the oscillating characteristics, a parallel circuit of resistor 6 and capacitor 18, auxiliary switch 10 and main switch 9 to the negative terminal of battery 1, while a base current is allowed to flow to the oscillating transistor 3. Therefore, booster circuit I starts to operate, and oscillating transistor 3 is in the ON state. Primary winding P of the oscillation transformer 5 is thus supplied with electrical power for a period during which the oscillation transformer is capable of reaching magnetic saturation, while an alternating voltage of magnitude the ratio of turns times as high is induced in the secondary winding S of oscillation transformer 5. Booster circuit I continues performing such oscillating operation. This alternating current is converter to a direct current by the high voltage rectifier diode 7, which is applied to charge storage capacitor 8.

Voltage stored on the capacitor 8 increases with time. When it reaches a value necessary to maintain the amount of flash light emitted from flash discharge tube 13 at a proper level, the neon lamp 14, which acts as the pilot lamp for indicating when the storage capacitor 8 is fully charged, is discharged through a resistor 19, and lit. At the same time, a potential appears across resistor 15 and a base current flows to transistor 20, thereby rendering the collector-emitter path of transistor 20 conductive. A light-emitting diode 12 positioned in the field of view of a finder (not shown) is then energized with current flowing from battery 21 through resistor 22. As it gives off light, the photographer looking through the finder is informed of the fact that the flash device is ready to fire.

Meanwhile, a trigger capacitor 23 is charged in proportion to the voltage on the storage capacitor 8 through resistors 19 and 24 and the primary winding of a trigger transformer 25. When the neon lamp 14 is lit, the voltage stored on capacitor 23 is kept at a level for sustaining the discharge of the neon lamp 14.

When a shutter release is then actuated, a correct exposure value is computed from the automatically metered object distance and the preset value of guide number to adjust the period of actuation of a shutter. When the shutter operation changes from the opening operation to a closing operation, an exposure control circuit 26 in the form of a CMOS type integrated circuit produces an actuating signal which is applied through the connection terminals c' and c and a resistor 28 to a gate electrode of a thyristor 27. Thyristor 27 is thus turned on and the charge on the trigger capacitor 23 is given to the primary winding of trigger transformer 25 in the form of an impulse, inducing a high voltage of damped oscillation By this induced voltage, the flash discharge tube 13 is excited. The charge stored on the capacitor 8 is then discharged through the tube 13. Thus, the required amount of flash light for the proper exposure value is emitted.

Assume that after the storage capacitor 8 has been charged to a voltage necessary to maintain the amount of flash light emitted from the flash discharge tube 13 at a proper level, without making a flash exposure, the main switch 9 is manually opened so that pole 9*s* contacts contact 9*b*. Operation of the booster circuit I stops. At the same time, the series circuit of the neon lamp 14 and resistor 15 is short-circuited at the ends thereof through the contacts 9*b* and 9*c* of the main switch 9. Because the anode of the neon lamp 14 is grounded, the neon lamp 14 is turned off, and the trigger circuit is rendered inoperative. Assume again that soon after that, that is, before the charge on the storage capacitor 8 all disappears, The electronic flash device is detached from the camera. The auxiliary switch is opened, but the charge on the storage capacitor 8 continues discharging through the diode 16 connected in parallel with the auxiliary switch 10. Therefore, the potential at the anode of the neon lamp 14 is maintained at a higher level than that at the circuit earth terminal, this potential is only equal to the forward potential drop (about 0.6 volts) of the diode 16. Therefore, the neon lamp 14 is no longer lit.

It will be understood from the foregoing that when the main switch 9 is switched from its ON to its OFF state, or when chattering takes place at the transit of the main switch 9 to the ON state, as has been described above, a surge voltage is produced between the line A and the line B. However since, in the embodiment of the invention illustrated in FIG. 3, all the signal terminals a', b' and c' are connected to the line B either directly or through a circuit element such as the resistor 28 and transistor 20, the surge voltage between the lines A and B is never applied across the camera. Even when the exposure control circuit 26 in the camera is constructed of CMOS type integrated circuit units, there is no possibility of causing any withstand voltage damage to them.

Another advantage is that after the main switch 9 has been turned off, there is no need for the photographer to wait for the charge on storage capacitor 8 to fully discharge before the auxiliary switch 10 can be turned off without causing the neon lamp 14 to be lit. Therefore, after the electronic flash device is ready for the next flash exposure, deciding not to proceed with the device, the photographer may remove the device from the camera as soon as the main switch is turned off. Even in this case, no spurious indication that the electronic flash device is operative again is presented by the neon lamp, as the neon lamp remains off. This is important when the electronic flash device is of the type described. If the neon lamp were lit again at the time of removal of the device from the camera, the photographer would think something was wrong because even though the main switch had been turned off before the device was detached from the camera, the electronic flash device would appear as if it were starting to operate again.

In FIG. 3, the diode 16 corresponds to the one-way semiconductor element of the invention, and the neon lamp 14 corresponds to the indicator lamp for detecting when the storage capacitor is fully charged.

Also, according to the invention, the series-connected circuit of main switch 9 and auxiliary switch 10 is not included in the primary loop of the booster circuit I, which primary loop contains the primary winding P of oscillation transformer 5, but is included in the secondary loop of relatively smaller current, thereby giving an additional advantage that the influence in increase of the resistance at the interface between the switch contacts 9*s* and 9*a* and between the contacts 10*s* and 10*a* on the performance of the DC-DC converts can be lessened.

As has been described in greater detail above, according to the present invention, the auxiliary switch is connected in series to the main switch at such a position that it is farther from the negative terminal of the battery than the main switch, and the one of the contacts of the auxiliary switch which is connected to a signal terminal is connected to the negative pole of a storage capacitor, whereby the circuit connecting the signal terminal to another signal terminal is not cut off when either the main switch or the auxiliary switch is turned off. With the electronic flash device left attached to the camera, therefore, the surge voltage produced by changing the main switch from the ON to the OFF state does not cause withstand voltage damages of the electronic circuit in the camera as it is applied backward to the camera. Further, the signal terminal connected to one of the contacts of the auxiliary switch may be used as the common circuit earth of the other signal terminals, thereby reducing the necessary number of parts. This is advantageous as to compactness and lowering production cost.

Further in the aforesaid arrangement of the constituent parts, when a one-way semiconductor element is connected in parallel to the auxiliary switch and oriented so that its forward direction coincides with the direction in which the charging completion indicator lamp is short-circuited, the indicator lamp is maintained short-circuited by the one-way semiconductor element against the turning off of the auxiliary switch. Therefore, the opening of the main switch followed immediately by detaching the electronic flash device from the camera while the storage capacitor is fully charged allows the indicator lamp to remain off, thereby preventing the photographer from thinking the electronic flash device had started operating again.

What we claim is:

1. An electronic flash device for a camera comprising:

(A) a closed circuit including an electrical power source having positive and negative terminals, a booster circuit having an oscillation transformer with a secondary winding for oscillating and boosting the voltage of said electrical power source to a higher secondary voltage, a high voltage rectifier element for rectifying the second voltage produced by said booster circuit, and a main capacitor having positive and negative poles;

(B) a flash lamp connected to said capacitor;

(C) a main electrical power source switch inserted into said closed circuit;

(D) an auxiliary electrical power source switch having two sides and arranged to close when said device is attached to the camera, said auxiliary electrical power source switch being in said closed circuit in series with said main electrical power source switch but positioned farther from the negative terminal of said electrical power source than said main electrical power source switch;

(E) a first signal terminal, means connecting said first signal terminal to the negative pole of said main capacitor; and (F) a second signal terminal connected to the one of the two sides of said auxiliary electrical power source switch more remote from the negative terminal.

2. A device according to claim 1, wherein said first and second signal terminals are brought into connection with each other through an integrated circuit in the camera when said device is attached to the camera.

3. A device according to claim 1, further comprising:

(F) an indicator for indicating that said main capacitor is fully charged;

(G) a circuit line arranged to connect with a positive electrode side of said main electrical power source switch when said main electrical power source switch is turned off, said circuit line being connected to a positive electrode side of said full charging indicator; and (H) a one-way semiconductor element connected in parallel with said auxiliary electrical power source switch and oriented so that its forward direction coincides with the direction in which said full charging indicator is short-circuited.

4. An electronic flash device for a camera comprising:

(A) a closed circuit including an electrical power source having positive and negative terminals, a booster circuit having an oscillation transformer for oscillating and boosting the voltage of said electrical power source to a higher secondary voltage, a high voltage rectifier element for rectifying the second voltage produced by said booster circuit, and a main capacitor having positive and negative poles;

(B) a flash lamp connected to said capacitor;

(C) a main electrical power source switch inserted into said closed circuit;

(D) an auxiliary electrical power source switch having a two sides and arranged to close when said device is attached to the camera, said auxiliary electrical power source switch in said closed circuit in series with said main electrical power source switch but positioned farther from the negative terminal of said electrical power source than said main electrical power source switch;

(E) a first signal terminal, means connecting said first signal terminal to the negative side of said main capacitor; and (F) a second signal terminal connected to the one of the two sides of said auxiliary electrical power source switch.

5. A device according to claim 4, wherein said first and second signal terminals are brought into connection with each other through an integrated circuit in the camera when said device is attached to the camera.

6. A device according to claim 4, further comprising:

(F) an indicator for indicating that said main capacitor is fully charged and having a positive side and a negative side;

(G) said main electrical power source switch having a positive side and a negative side, a circuit line arranged to connect with positive side of said main electrical power source switch when said main electrical power source switch is turned off, said circuit line being connected to a positive side of said full charging indicator; and (H) a one-way semiconductor element connected in parallel with said auxiliary electrical power source switch and oriented so that its forward direction coincides with the direction in which said full charging indicator is short-circuited.

7. An electronic flash unit for a camera, comprising:

a circuit including conductive means for connection to a power source and having positive and negative terminals for carrying a source voltage, a booster circuit having an oscillation transformer for boosting the source voltage to a higher secondary voltage, a high voltage rectifier element for rectifying the secondary voltage, and a main capacitor having positive and negative poles;

a flash lamp connected to said capacitor;

a main power switch in said circuit;

an auxiliary power source having two sides and arranged to close when said flash unit is attached to the camera;

said auxiliary power switch being in series with said main power switch but further from said negative terminal than said main power switch;

a first signal terminal, means connecting said first signal terminal to the negative pole of said main capacitor; and a second signal terminal connected to the one of the two sides of said auxiliary power switch more remote from the negative terminal.

8. A device as in claim 7, wherein said first and second signal terminals are brought into connection with each other through an integrated circuit in the camera when said device is attached to the camera.

9. A device as in claim 7, further comprising:

an indicator for indicating that said main capacitor is fully charged and having a positive electrode and a negative electrode;

said main power switch having a positive side and a negative side, a circuit line for connection with the positive side of said main power switch when said main power switch is turned off;

said circuit line being connected to the positive side of said full charging indicator; and a one-way semiconductor element connected in parallel with said auxiliary power switch and polled to short-circuit said full charging indicator.

* * * * *